United States Patent [19]

Kotera

[11] Patent Number: 4,616,494

[45] Date of Patent: Oct. 14, 1986

[54] METHOD OF AND APPARATUS FOR CONTROLLING LOAD DISTRIBUTION FOR A CONTINUOUS ROLLING MILL

[75] Inventor: Yoshikazu Kotera, Hyogo, Japan

[73] Assignee: Mitsubishi Denki Kabushiki Kaisha, Tokyo, Japan

[21] Appl. No.: 660,273

[22] Filed: Oct. 12, 1984

[30] Foreign Application Priority Data

Oct. 15, 1983 [JP] Japan ..... 58-192738

[51] Int. Cl.[4] ..... B21B 37/08

[52] U.S. Cl. ..... 72/8; 72/20; 72/21; 72/234; 72/240; 72/245; 364/472

[58] Field of Search ..... 72/8, 16, 20, 234, 21, 72/240, 245; 364/472

[56] References Cited

U.S. PATENT DOCUMENTS 4,485,497 12/1984 Miura ..... 72/8 X

*Primary Examiner*—Francis S. Husar

*Assistant Examiner*—Steve Katz

*Attorney, Agent, or Firm*—Bernard, Rothwell & Brown

[57] ABSTRACT

A method of and an apparatus for controlling the load distribution ratio among a plurality of stands in a continuous rolling mill preferentially performs load distribution ratio control between or among a group of downstream side ones of the stands including the last stand to appropriately correct the load distribution ratio between or among the downstream side stands.

Subsequently, correction of the load distribution ratio is performed for a group of the downstream side stands and an upstream stand, and this will be repeated in order for the upstream side stands to effect correction of the load distribution ratio for the entire stands.

1 Claim, 1 Drawing Figure

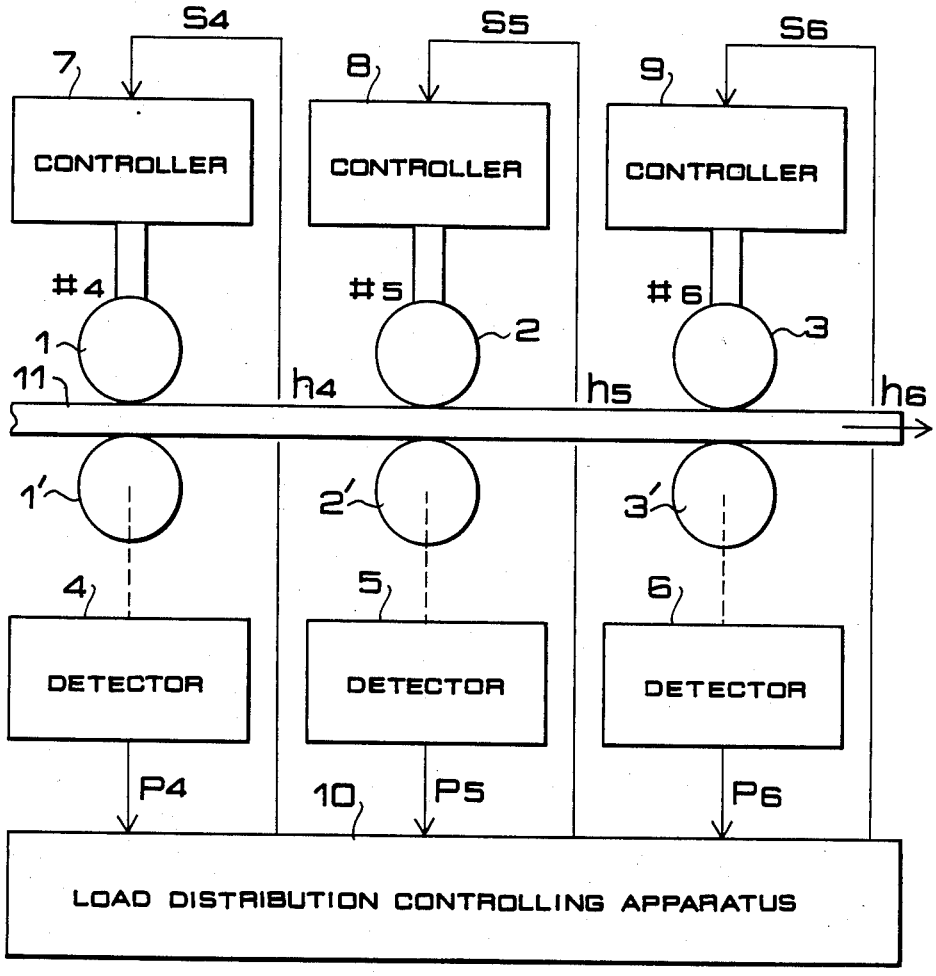
S4
S5
S6
7
8
9
CONTROLLER
CONTROLLER
CONTROLLER
#4
#5
#6
1
2
3
11
h4
h5
h6
1'
2'
3'
4
5
6
DETECTOR
DETECTOR
DETECTOR
P4
10
P5
P6
LOAD DISTRIBUTION CONTROLLING APPARATUS

METHOD OF AND APPARATUS FOR CONTROLLING LOAD DISTRIBUTION FOR A CONTINUOUS ROLLING MILL

BACKGROUND OF THE INVENTION

This invention relates to a continuous rolling mill, and more particularly to a load distribution controlling method and apparatus for controlling a load distribution ratio of stand rolling loads among all of the stands of a continuous rolling mill to a preset value therefor in a short period of time.

DESCRIPTION OF THE PRIOR ART

Generally, in a continuous rolling mill, a rolling load to each of the stands is required to come within an appropriate range of a load distribution ratio depending upon stability in operation, shape and quality of the products and so on, in addition to the rated values of the machine.

However, in actual rolling, due to a limit in the accuracy of the expressions of rolling models used for design calculations or due to various measurement errors and rolling disturbances, rolling loads to individual stands, that is, a load distribution ratio among the stands, do not, in most cases, coincide with their respective estimated values, that is, a preset value of the load distribution ratio.

Conventionally, in order to eliminate such disadvantages, it has been a practice for a mill operator to watch the rolling operation and to manually adjust the machine at a suitable time to the correct load distribution ratio to ensure accuracy of the products while continuing the operation of the machine.

SUMMARY OF THE INVENTION

It is an object of the present invention to provide a load distribution controlling method and apparatus for a continuous rolling mill wherein corrective controlling of the load distribution ratio among the stands of the rolling mill can be effected by quick and simple calculation processes and wherein prevention of the production of unsatisfactory products, stabilization of the rolling operation, and reduction of mental and physical burdens to a mill operator are attained.

According to the load distribution controlling method and apparatus of the present invention, it is first judged if a load distribution ratio among a plurality of stands, including the most downstream stand, coincides with a preset value of the load distribution ratio, and if coincidence is not found, then controlling of the load distribution ratio is performed. On the contrary, if coincidence is found, similar judgement and controlling are performed for the stands and an adjacent upstream stand is added thereto. Thus the range of such judgement and controlling is expanded successively to upstream stands.

BRIEF DESCRIPTION OF THE DRAWINGS

A single FIGURE of the drawing is a diagrammatic representation illustrating an embodiment of a load distribution controlling method for a continuous rolling mill according to the present invention.

DETAILED DESCRIPTION OF THE PREFERRED EMBODIMENTS

First, description will be given of load changing amounts at individual stands. In order to correct rolling load amounts at individual stands, changing of rolling reduction rates in plate thickness is utilized. A plate thickness rolling reduction rate ri at a given stand is determined in accordance with the following expression depending upon an entry side plate thickness Hi and an exit side plate thickness hi at the stand.

$$ri=(Hi-hi)/Hi \tag{1}$$

Here, it is assumed that changing of a screw rolling reduction position is chosen as an operational variable for causing a change in a plate thickness rolling reduction rate.

Now, the present invention will be described in connection with correction of a load distribution at three downstream stands including the last stand of a rolling mill which has up to, for example, six stands. Rolling loads at the #4, #5 and #6 stands are represented by P4, P5 and P6, respectively, while preset values for a preset load distribution ratio among them are represented by C4, C5 and C6, respectively.

It is further assumed that plate thickness h6 on the exit side of the last stand coincides with an desired value of the thickness of the product. Thus, load changing amounts at the individual stands which are attained by correction of their individual rolling reduction rates within such ranges as will not change plate thickness H4 on the entry side of the #4 stand and plate thickness h6 on the exit side of the #6 stand are given by following expressions.

$$\left.\begin{aligned} \Delta P4 &= Q_i^h 4\Delta h4 \\ \Delta P5 &= Q_i^H 5\Delta H5 + Q_i^h 5\Delta h5 \\ \Delta P6 &= Q_i^H 6\Delta H6 \end{aligned}\right\} \tag{2}$$

Here, $Q_i^H$ is the influence which a change ΔHi in plate thickness on the entry side had on a rolling load amount Pi, and $Q_i^h$ is the influence which a change Δhi in plate thickness of the exit side had on the rolling load amount.

In the following description, for simplification, Qi will be used as $Q_i^h = -Q_i^H$. And from the condition of continuity, $$\left.\begin{aligned} \Delta H5 &= \Delta h4 \\ \Delta H6 &= \Delta h5 \end{aligned}\right\} \tag{3}$$

and hence, unknown variables which can be chosen in this part are Δh4 and Δh5. As a condition for a distribution ratio after load changing to coincide with the distribution rate, the following expression can be obtained $$(P4+\Delta P4):(P5+\Delta P5):(P6+\Delta P6)=C4:C5:C6 \tag{4}$$

or otherwise, using an arbitrary constant k, the following expressions can be obtained.

$$\begin{aligned} P4 + (-Q4 \cdot \Delta h4) &= k \cdot C4 \\ P5 + (Q5 \cdot \Delta h4 - Q5 \cdot \Delta h5) &= k \cdot C5 \\ P6 + (Q6 \cdot \Delta h5) &= k \cdot C6 \end{aligned} \tag{5}$$

Plate thickness correcting amounts Δh4 and Δh5 required for correction from measured values of rolling load amounts P4, P5 and P6 at the individual stands to values for a preset value Ci of a load distribution ratio thereamong can be obtained from the expressions (5) as follows:

$$\begin{pmatrix} k \\ \Delta h5 \\ \Delta h4 \end{pmatrix} = \begin{pmatrix} C6 & -Q6 & \\ C5 & Q5 & -Q4 \\ C4 & & Q4 \end{pmatrix}^{-1} \begin{pmatrix} P6 \\ P5 \\ P4 \end{pmatrix} \tag{6}$$

$$\left.\begin{aligned} &= \frac{1}{\Delta 3}\begin{pmatrix} Q4Q5 & Q6Q4,\ Q5Q6 \\ -(C5Q4 + C4Q5), & C6Q4,\ C6Q5 \\ -C4Q5, & -C4Q6,\ (C6Q5 + C5Q6) \end{pmatrix}\begin{pmatrix} P6 \\ P5 \\ P4 \end{pmatrix} \\ \Delta 3 &= C6Q4Q5 + C5Q6Q4 + C4Q5Q6 \end{aligned}\right\} \tag{7}$$

Calculation of the reverse determinant of the expression (6) can be attained by the following steps. In particular, if $$M2 = \begin{pmatrix} C6 & -Q6 \\ C5 & Q5 \end{pmatrix} \tag{8}$$

$$M3 = \begin{pmatrix} & & 0 \\ & M2 & -Q5 \\ C4 & 0 & Q4 \end{pmatrix} \tag{9}$$

then the reverse determinant R2 corresponding to the determinant M2 is determined by $$R2 = \frac{1}{\Delta 2}\begin{pmatrix} Q5,\ Q6 \\ -C5,\ C6 \end{pmatrix} \tag{10}$$

where $\Delta 2 = C6 \cdot Q5 + C5 \cdot Q6$. Thus, the load distribution control at the downstream stand is such that a plate thicknesss correction amount $\Delta h5$ is determined by the reverse determinant R2. Using the calculated value of the reverse determinant R2, the reverse determinant R3 corresponding to the determinant M3 can be calculated as follows:

$$\left.\begin{aligned} R3 &= [R2] + \frac{1}{\delta 3}\left[\begin{array}{c:c} R2\begin{pmatrix} 0 \\ -Q5 \end{pmatrix}^{(C4\ 0)} R2 & -R2\begin{pmatrix} 0 \\ -Q5 \end{pmatrix} \\ \hdashline -(C4,0)R2 & 1 \end{array}\right] \\ \delta 3 &= Q4 - (C4,0)R2\begin{pmatrix} 0 \\ -Q5 \end{pmatrix} \end{aligned}\right\} \tag{11}$$

If the result of the expression (10) is substituted into the expression (11), the following expression can be obtained:

$$\begin{aligned} R3 &= \frac{1}{\Delta 2}\begin{bmatrix} Q5 & Q6, & 0 \\ -C5, & C6, & 0 \\ 0, & 0, & 0 \end{bmatrix} + \\ &\quad \frac{1}{\delta 3 \cdot \Delta 2}\left[\begin{array}{c:c} \frac{Q5}{\Delta 2}\begin{pmatrix} Q6 \\ C6 \end{pmatrix} C4^{(Q5,\ Q6)} & Q4\begin{pmatrix} Q6 \\ C6 \end{pmatrix} \\ \hdashline -C4(Q5,\ Q6) & \Delta 2 \end{array}\right] \\ &= \frac{1}{\Delta 3}\begin{bmatrix} Q4Q5, & Q6Q4,\ Q5Q6 \\ -(C5Q4 + C4Q5), & C6Q4,\ C6Q5 \\ C4Q5, & -C4Q6,\ (C6Q5 + C5Q6) \end{bmatrix} \end{aligned} \tag{12}$$

The expression (12) is the same as the first term on the right side of the expression (7) above, and thus it can be seen that calculation of the reverse determinant of three rows and three columns can be attained by the procedure of the expression (11) above.

The sequential calculation of the expression (11) can be applied similarly for the load distribution control on the upstream side. In particular, $$\left.\begin{aligned} R4 &= R3 + \frac{1}{\delta 4}\left[\begin{array}{c:c} R3\begin{pmatrix} 0 \\ 0 \\ -Q4 \end{pmatrix}^{(C3,0,0)} R3 & -R3\begin{pmatrix} 0 \\ 0 \\ -Q4 \end{pmatrix} \\ \hdashline -(C3,0,0)R3 & 1 \end{array}\right] \\ \delta 4 &= Q3 - (C3,0,0)R3\begin{pmatrix} 0 \\ 0 \\ -Q4 \end{pmatrix} \end{aligned}\right\} \tag{13}$$

A rolling load amount P'i after correction by changing of the plate thickness thus calculated is proved to coincide with the preset value therefor:

$$\begin{aligned} \begin{pmatrix} P6' \\ P5' \\ P4' \end{pmatrix} &= \begin{pmatrix} P6 \\ P5 \\ P4 \end{pmatrix} + \begin{bmatrix} Q6 & & \\ -Q5 & Q5 & \\ & & -Q4 \end{bmatrix} \frac{1}{3}\begin{bmatrix} -(C5Q4 + C4Q5), & C6Q4,\ C6Q5 \\ -C4Q5, & -C4Q6,\ (C6Q5 + C5Q6) \end{bmatrix}\begin{pmatrix} P6 \\ P5 \\ P4 \end{pmatrix} \\ &= \frac{1}{\Delta 3}\begin{bmatrix} \Delta 3 - Q6(C5Q4 + C4Q5), & C6Q6Q4, & C6Q5Q6 \\ C5Q4Q5 & 3 - Q5(C6Q4 + C4Q6), & C5Q5Q6 \\ C4Q4Q5, & C4Q6Q4,\ 3 - Q4(C6Q5 + C5Q6) & \end{bmatrix}\begin{pmatrix} P6 \\ P5 \\ P4 \end{pmatrix} \\ &= \begin{pmatrix} C6 \\ C5 \\ C4 \end{pmatrix} \frac{(Q4Q5,\ Q6Q4,\ Q5Q6)}{\Delta 3}\begin{pmatrix} P6 \\ P5 \\ P4 \end{pmatrix} \end{aligned} \tag{14}$$

Accordingly, the rolling load amount can be corrected to any of rolling load amounts P'4, P'5, P'6, and the preset values for the preset load distribution ratio become C4, C5 and C6 and thus can be made coincide with the desired values.

Also for the load distribution control at the downstream side #3, #4, #5 and #6 stands, changes in plate thickness $\Delta h3$, $\Delta h4$ and $\Delta h5$ at the exit sides will be calculated similarly by calculations of plate thickness changing amounts using the result of the expression (13) above.

As a result, the rolling load amounts P'3, P'4, P'5 and P'6, after changing, are corrected such that the load distribution ratio thereof coincides with the preset value of the load distribution ratio C3, C4, C5, C6.

Also in the case where there are a greater number of stands, calculation of coefficients on the upstream side is possible using the results of calculations on the downstream side based on the sequential calculation, and the procedure to directly carry out calculations of a reverse determinant to a determinant of a high dimension can be eliminated.

The effect of carrying out controlling of one after another of stands from the downstream side as described above is beneficial in addition, calculation of reverse determinants at a following point is simplified. In particular, in interstand load distribution control, the effect is realized only after the lapse of a period of time in which a point on a plate material being rolled travels from the most upstream one of the stands for which load distribution is to be corrected to the most downstream one of the stands.

The travelling speed of a plate material in a rolling mill is naturally lower at an upstream stand and higher at a downstream stand. However, the distance between adjacent stands is normally constant. Accordingly, the interstand speed at a downstream stand is naturally higher than that at an upstream stand and hence the period of time required for completing the load distribution correction control is shorter.

Moreover, to realize the load distribution control at an earlier point of time at a downstream stand than at an upstream stand conforms very well to the actual conditions of operation in which the various problems with respect to stabilization of running of a plate material are apt to appear at downstream side stands and in which a factor which has a seriously bad influence on the shape of the product is a load balancing condition at the exit stand.

Now, an embodiment of the present invention will be described with reference to the accompanying drawing.

The FIGURE illustrates downstream side stands (#4, #5 and #6) in a continuous rolling mill. A plate material 11 is rolled while travelling through rolls 1-1', 2-2' and 3-3' of the stands. Rolling load amounts are detected by detectors 4, 5 and 6 provided therefor and are coupled to a load distribution controlling apparatus 10.

It is assumed that the thickness h6 of the plate on the exit side of the rolling mill is already controlled to the plate thickness of a product to be obtained. The load distribution controlling apparatus 10 at first calculates a plate thickness changing amount Δh5 in accordance with the expression (10) using the rolling load amounts P5 and P6 at the downstream side stands #5 and #6. Rolling reduction position changes S5 and S6 to realize the plate thickness changing amount h5 are then delivered to the rolling reduction position controlling devices 8 and 9, respectively. As a result, the rolling load amounts P'5 and P'6 after correction of loads are made coincide with the preset values for the preset load distribution ratio C5:C6.

Subsequently, using the rolling load changing amounts P4, P5 and P6 at the downstream stands #4, #5 and #6, respectively, plate thickness changing amounts Δh4 and Δh5 are calculated in accordance with the expression (12) above, and rolling reduction position changes ΔS4, ΔS5 and ΔS6 to realize the plate thickness changing amounts are delivered to the rolling reduction position controlling devices 7, 8 and 9, respectively. As a result, rolling load amounts P'4, P'5 and P'6 after correction of loads can be made coincide with the preset values for the preset load distribution ratio C4:C5:C6.

Calculation from a plate thickness changing amount to a rolling reduction position changing amount for load distribution correction can be attained in accordance with a following expression:

$$\begin{pmatrix} \Delta S4 \\ \Delta S5 \\ \Delta S6 \end{pmatrix} = \begin{bmatrix} \frac{m4 + q6}{m4} \\ -\frac{q5}{m5}, \frac{m5 + q5}{m5} \\ -\frac{q6}{m6} \end{bmatrix} \begin{pmatrix} \Delta h4 \\ \Delta h5 \end{pmatrix} \quad (15)$$

where mi is the mill spring constant at a given stand, and qi is the plasticity hardness of the plate material (it is assumed that the true values are already known).

If an instruction value for rolling reduction position changing is delivered each time a plate thickness changing point on the plate material arrives at a downstream stand, off gage plate thickness product will not be caused. The load distribution controlling apparatus 10 regulates such timing in response to information of a plate material travelling speed.

While description of a preferred embodiment of the invention has been given by way of examples of the load distribution control at the #5 to #6 stands and the load distribution control at the #4 to #6 stands, it is natural that similar operations may be effected in order for an increased number of stands and hence the load distribution ratio among all of the stands can be made coincide with a desired value therefor.

As apparent from the foregoing description, according to the present invention, a load distribution ratio among stands can be controlled and corrected in a very short period of time by simplified calculating processes without any deterioration of accuracy in plate thickness of the product, and control at the downstream stands which is material for stabilization of movement of a plate or for maintaining shape of the product can be effected in a shorter period of time. Accuracy of products and prevention of production of products having an unacceptable configuration as well as stabilization of rolling operation can be achieved, and maximal utilization of rated values of the rolling mill and substantial reduction of mental and physical burdens for a mill operator are also achieved.

While description has been given as if a rolling load amount denotes either required rolling torque or required electric power, distribution of rolling forces and rolling reactive forces among stands is also material, and the utilization of such other forces in the operation is considered to come within the spirit of the invention.

What is claimed is:

1. A load distribution controlling method for a continuous rolling mill for rolling plate material, comprising the steps of:

judging whether the rolling load amounts at two downstream stands, including the most downstream stand, coincide with preset values for a preset load distribution ratio;

calculating, if coincidence is not found, changing amounts to plate thickness rolling reduction rates at said two downstream stands;

correcting the rolling reduction position at said two downstream stands in accordance with the thus calculated changing amounts to effect load distribution control;

judging, when the rolling load amounts at said two downstream side stands are made to coincide with the values for the preset load distribution ratio by the load distribution control, whether rolling load amounts at the three downstream stands coincide with values for a preset load distribution ratio;

calculating, if coincidence is not found, changing amounts to the plate thickness rolling reduction rates at said three downstream stands;

correcting the rolling reduction positions at said three downstream stands in accordance with the changing amounts thus calculated to effect load distribution control;

repeating, in a similar manner, such correction of the load distribution ratio depending upon a determination whether a desired load distribution ratio is established among a plurality of stands, always including the last stand; and repeating such correction of the load distribution ratio successively to stands further upstream in said rolling mill.

* * * * *